United States Patent [19]

Farr

[11] 4,052,951

[45] Oct. 11, 1977

[54] ROWING DEVICE FOR A FORWARD FACING ROWER

[76] Inventor: Alton E. Farr, 14050 B Marquesas Way, Marina del Rey, Calif. 90291

[21] Appl. No.: 647,916

[22] Filed: Jan. 9, 1976

[51] Int. Cl.[2] ..... B63H 16/10

[52] U.S. Cl. ..... 115/24.1

[58] Field of Search ..... 115/24.1, 24.2, 24.3; 416/74

[56] References Cited

U.S. PATENT DOCUMENTS

| | | | |
|---|---|---|---|
| 67,285 | 7/1867 | Fuzzard | 115/24.1 |
| 557,318 | 3/1896 | Tenney | 416/74 |
| 1,070,448 | 8/1913 | Gilbertson | 115/24.2 |
| 1,353,027 | 9/1920 | Clay | 115/24.2 |
| 2,189,975 | 2/1940 | Carlson | 115/24.2 |

FOREIGN PATENT DOCUMENTS

| | | | |
|---|---|---|---|
| 511,933 | 4/1955 | Canada | 115/24.2 |

*Primary Examiner*—Trygve M. Blix
*Assistant Examiner*—Stuart M. Goldstein
*Attorney, Agent, or Firm*—George W. Finch

[57] ABSTRACT

An oarlock design which permits the rower to face forwardly through the use of a second class lever wherein the oarlocks are restrained to move forwardly and backwardly along arculate side rails so that each oar translates about a vertical pivot point which is spaced across the boat away from the normal oarlock pivot point.

11 Claims, 4 Drawing Figures

ROWING DEVICE FOR A FORWARD FACING ROWER

BACKGROUND OF THE INVENTION

Mankind has used oars in simple pivoting oarlocks to propel his boats for over 3,000 years but such an arrangement has two distinct disadvantages. If no separate tiller is employed on the boat, the rower must steer his own course by judicious use of the oars. However, due to the normal rowing arrangement the rower must sit backwards to the course of the boat so that he can use his powerful leg and back muscles most effectively. Therefore he cannot see where he is going but only where he has been. This means that in any hands other than those of an expert, rowboats do not follow the desired straight line path when being rowed since it is normal for the rower to be stronger and therefore accidentally apply more force on one side than the other. This tends to gradually turn the boat into his weak side. Once the turn gets large enough to notice, it must be corrected by an extra stroke to the weak side or by a stronger stroke on the weak side.

The second disadvantage of the well known means to row a boat is that there is a substantial sideways component to the force applied by an oar both at the start and at the end of a stroke which does nothing to propel the boat but expends a considerable amount of energy from the rower. It has therefore been desired to develop an oar lock system which allows the oarsman to face forward and which enables him to apply a larger percentage of his total energy to propelling the boat forwardly.

BRIEF DESCRIPTION OF THE PRESENT INVENTION

In the present invention a second class lever arrangement rather than the common first class lever is employed. This is done by providing arculate tracks along the sides of the boat. A carriage is connected by rollers to each track. The rollers restrain each of the carriages to their track so that an oar held in two conventional oarlocks attached to the carriage move in generally the same arc as the track. The handle and blade of the oar both move in the same direction during a stroke rather than in opposite directions, thereby enabling the rower to face forwardly. The arc of the track can have a curvature such that the same mechanical motion advantage between movement of the oar handle and movement of the blade is present as when conventional oarlocks are used. However, since the oar is in fact acting as a second class lever, the movement radius of its blade is much larger resulting in less angular travel of the blade as viewed from above which results in more efficient propulsion. Ordinary oars can be used along with ordinary oarlocks so that unshipping and feathering of the oars is still possible while the rollers on the track allow dipping of the oar blade as desired by the rower.

It is therefore a principal object of the present invention to provide improved means for rowing a boat which enable the rower to face the direction that the boat is traveling while using his powerful leg and back muscles to provide propulsive energy into the oar.

Another object is to provide means for rowing a boat which simplifies the rowing problem for novice rowers.

Another object is to provide means for rowing boats such as life boats where it is desired for the rower to keep constant visual contact with a person in trouble in the water.

Another object is to provide means for superior boat-handling when rowing boats in rough seas and when beaching boats in heavy surf wherein visual contact with the on-coming waves facilitates optimum dip of the oars.

Another object is to provide means for improving the propulsive efficiency of rowboats.

Another object is to provide improved rowing means which are relatively economical to manufacture and maintain and are easily installed on boats requiring oars for propulsion.

Another object is to eliminate the need for a steering helmsman or coxswain on a racing shell boat.

These and other objects and advantages of the present invention will become apparent to those skilled in the art after considering the following detailed specification which discloses a preferred embodiment thereof in conjunction with the accompanying drawing wherein:

DETAILED DESCRIPTION OF THE SHOWN EMBODIMENT

Figure 1:
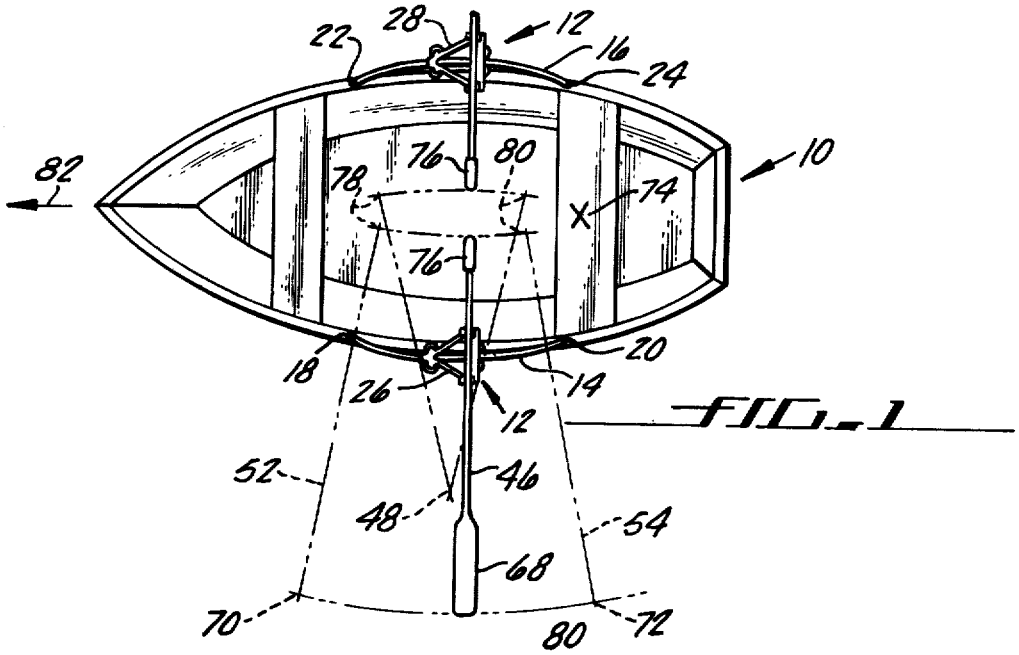
FIG. 1 is a top plan view of a rowboat with the present invention installed thereon.
Figure 2:
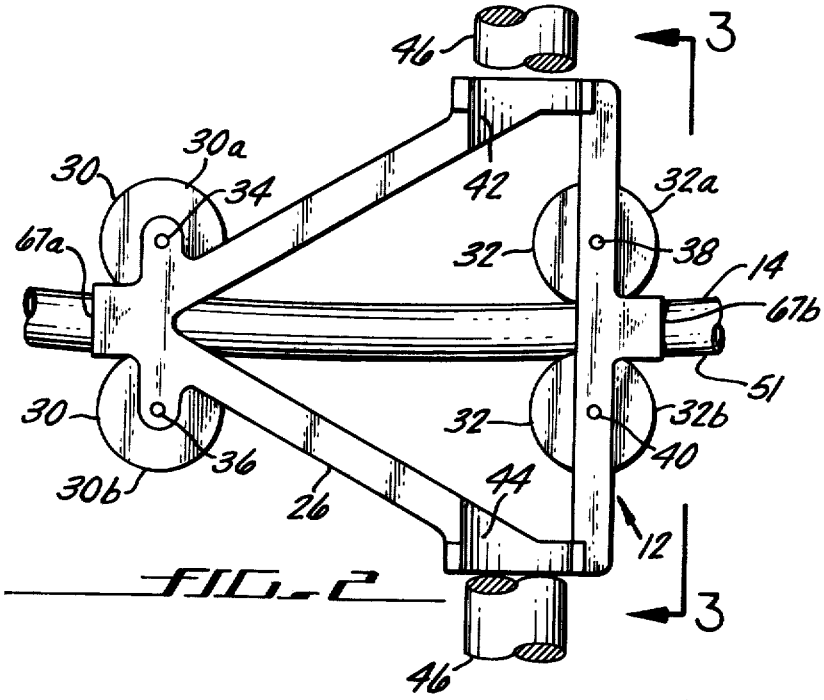
FIG. 2 is an enlarged top plan view of the oarlock carriage of the present device.

Referring to the drawing more particularly by reference numbers, number 10 in FIG. 1 refers to a rowboat having the oar propulsion device 12 of the present invention installed thereon. The device 12 includes a pair of arculate track members 14 and 16 attached to the boat 10 at their opposite ends 18 and 20, and 22 and 24 respectively. Dual function oarlock carriages 26 and 28 which direct the stroke and enable oar dip and feather are mounted and restrained to the tracks 14 and 16 respectively by adjacent pairs 30 and 32 of forwardly and rearwardly mounted rollers **30*a*, 30*b*, 32*a* and 32*b* which rotate about generally vertically oriented axes 34, 36, 38 and 40. After reading this specification it should be obvious that two spaced rollers on one side of the rail and one roller therebetween on the opposite side can also be used. The carriages 26 and 28 each include an inner oarlock 42 and an outer oarlock 44 which can be U-shaped as shown or be of any other conventional oarlock construction. The pairs of oarlocks 42 and 44 restrain conventional oars 46 to rotate as if they are pivoted about virtual pivots 48 spaced therefrom whose positions are determined by the curvature of the track 14 and 16**.

Figure 3:
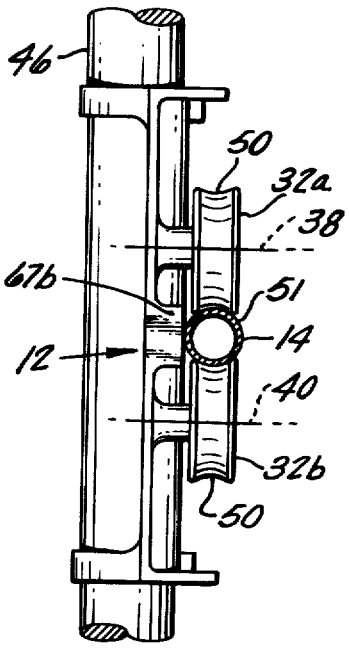
FIG. 3 is a side cross-sectional view taken on line 3—3 of FIG. 2.

As can be seen in FIG. 3, all of the rollers have a semi-circular concave outer surface 50 which engages the track 14 which has a mating circular outer surface 51. This arrangement enables the roller pairs 30 and 32 to roll along the track and also to slide radially about the track so that the oar 46 can be dipped in the water at the start of the stroke as shown by position 52 and can be removed from the water at the end of the stroke as as shown by position 54. The surfaces 51 of the circular surface tracks 14 and the surfaces 50 of the rollers can be coated with suitable lubricant to assure easy sliding therebetween. Suitable lubricants can include dry lubricants such as molydium sulfide, or tetrafloraethylene, and in some applications may incude simple greases. Since standard oarlocks 42 and 44 and oars 46 can be used, conventional dipping, feathering and unfeathering techniques can be employed by the rower.

Figure 4:
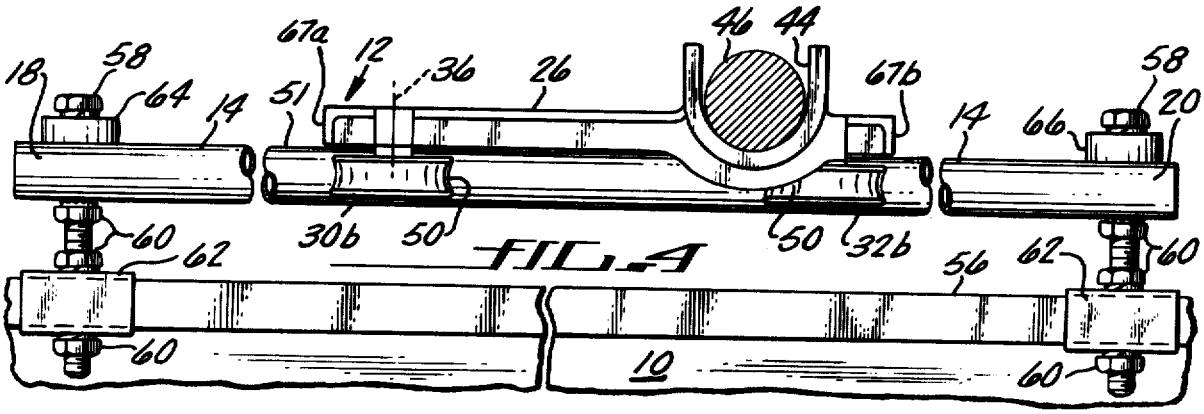
FIG. 4 is a fragmented side view of the present invention showing the track thereof attached to a boat gunnel.

As shown in FIG. 4, the tracks 14 and 16 can be mounted to the gunnels 56 of the boat 10 by suitable bolts 58, nuts 60 and clamps 62. Resilient bumpers 64 and 66 can be provided on the opposite ends of the tracks 14 and 16 and retained by the bolts 58. The bumpers 64 and 66 are used to prevent damage to the bolts 58 and the oarlock carriages 26 and 28 during energetic stroking. Abutment members 67*a* and 67*b* can be provided at the opposite ends of the carriages 26 and 28 to engage the bumpers 64 and 66. Since the tracks 14 and 16 are located on the gunnels 56 and the carriages 26 and 28 are relatively compact, they do not unnecessarily restrict the space within the boat 10 which can be used for cargo or personal.

By referring again to FIG. 1 it can be seen that the blade 68 of the oar 48 follows an arculate path from point 70 to point 72 during a power stroke while the rower seated on seat 74 applies force to the oar handles 76 which each move from positions 78 to 80, a distance less than the distance from point 70 to point 72. It should be obvious from the path 80 of the blade 68 that very little motion of the blade is wasted translating toward or away from the boat 10 and most of the rower's energy therefore goes into propelling the boat forwardly as indicated by arrow 82 which is the same direction the rower faces.

Thus there has been shown and described a novel rowing device for a forward facing rower which fulfills all of the objects and advantages sought therefor. Many changes, modifications, alterations and other uses and applications will however, become apparent to those skilled in the art after considering this specification and the accompanying drawing. All such changes, modifications, alterations and other uses and applications which do not depart from the spirit and scope of this invention are deemed to be covered by this invention which is limited only by the claims which follow.

What is claimed is:

1. A rowing device which enables the rower to pull the handle of a substantially straight and continuous oar backward while facing the direction of motion of the boat comprising:

a rail connected to the boat; and a carriage including means for connecting said carriage said rail for predetermined movement about and along said rail, said last named means including at least three rollers which ride on said rail to restrain said carriage to longitudinal movements along said rail and rotational movements about said rail and restraint means on said carriage for engagement with a substantially straight and continuous oar and including at least two oarlocks connected to said carriage and positioned so that the oar is restrained so as to remain generally perpendicular to said rail during normal operation of said device.

2. The rowing device defined in claim 1 wherein said rail has opposite ends, said device including connection means which fixedly connect said rail to at least one of the gunnels of the boat.

3. The rowing device defined in claim 2 wherein said rail includes resilient abutment means at said ends thereof and said carriage includes abutment surfaces which engage said resilient abutment means to restrict the total movement of said carriage along said rail and to rebound the carriage therefrom.

4. The rowing device defined in claim 3 wherein said rail has a predetermined curvature from end to end thereof.

5. The rowing device defined in claim 4 wherein said predetermined curvature of said rail is convex with respect to the rower.

6. The rowing device defined in claim 1 wherein said carriage oar engagement means include at least two oarlocks connected to said carriage and wherein said rowing device also includes an oar that acts as a unitary member positioned in said oar locks.

7. The rowing device defined in claim 6 wherein said oarlocks are U-shaped facing so that the force of gravity tends to retain the oar therein.

8. The rowing device defined in claim 1 wherein said rail has a circular outer surface cross-section, said at least three rollers attached thereto having concave roller surfaces for engaging said circular outer surface of said rail.

9. The rowing device defined in claim 8 wherein four rollers are attached in pairs on opposite sides of said rail and at opposite ends of said carriage, said pairs of rollers having axes of rotation which are parallel.

10. The rowing device defined in claim 1 including:

a second rail connected to the boat on the opposite side from the other; and a second carriage connected for movement about and along said second rail, said second carriage including at least three rollers which ride on said rail to restrain movements of said carriage to longitudinal movements along said rail and rotational movements about said rail and second restraint means for engagement with another oar which restrains the stroking movements thereof to the movements of said second carriage.

11. The rowing device defined in claim 10 wherein said rails are positioned at equal distances along the sides of the boat.

* * * * *